US007414620B2

(12) United States Patent
Yoo

(10) Patent No.: US 7,414,620 B2
(45) Date of Patent: Aug. 19, 2008

(54) ENERGY RECOVERY APPARATUS AND METHOD OF A PLASMA DISPLAY PANEL

(75) Inventor: Ji Seung Yoo, Yongin (KR)

(73) Assignee: LG Electronic Inc., Seoul (KR)

( * ) Notice: Subject to any disclaimer, the term of this patent is extended or adjusted under 35 U.S.C. 154(b) by 719 days.

(21) Appl. No.: 10/949,610

(22) Filed: Sep. 24, 2004

(65) Prior Publication Data

US 2006/0066606 A1 Mar. 30, 2006

(51) Int. Cl.
*G09G 5/00* (2006.01)

(52) U.S. Cl. ..... 345/204; 345/60; 345/66; 345/67; 345/68

(58) Field of Classification Search ..... 345/37, 345/41, 60, 66, 67, 68, 204
See application file for complete search history.

(56) References Cited

U.S. PATENT DOCUMENTS

2001/0012005 A1* 8/2001 Choi ..... 345/211
2003/0222864 A1* 12/2003 Roh et al. ..... 345/204
2004/0212564 A1* 10/2004 Lee et al. ..... 345/60

FOREIGN PATENT DOCUMENTS

FR 2836587 8/2003
KR 10-2003-0018398 A 3/2003
WO WO 03/073406 A1 9/2003
WO WO 03/075252 A2 9/2003

* cited by examiner

*Primary Examiner*—Bipin Shalwala
*Assistant Examiner*—Vincent E. Kovalick
(74) *Attorney, Agent, or Firm*—Lee, Hong, Degerman, Kang & Schmadeka

(57) ABSTRACT

The present invention relates to a plasma display panel, and more particularly, to an energy recovery apparatus of a plasma display panel and method thereof. The energy recovery apparatus includes a capacitive load equivalently formed between a scan electrode and a sustain electrode, an energy recovery unit for recovering energy charged in the capacitive load and again supplying the recovered energy to the capacitive load, an energy supply unit disposed between the energy recovery unit and the capacitive load, wherein the energy supply unit relays energy between the energy recovery unit and the capacitive load and supplying a reference voltage to the capacitive load so that stabilized discharging can be generated in the capacitive load, and an energy relay unit disposed between the energy recovery unit and the energy supply unit, for relaying energy between the energy recovery unit and the energy supply unit. According to the present invention, energy is relayed between a source capacitor and a panel capacitor through a transformer. Therefore, diodes need not to be used and manufacturing cost is thus reduced.

17 Claims, 7 Drawing Sheets

ENERGY RECOVERY APPARATUS AND METHOD OF A PLASMA DISPLAY PANEL

BACKGROUND OF THE INVENTION

1. Field of the Invention

The present invention relates to a plasma display panel, and more particularly, to an energy recovery apparatus of a plasma display panel and method thereof.

2. Description of the Background Art

A plasma display panel (hereinafter, referred to as a 'PDP') is adapted to display an image including characters or graphics by light-emitting phosphors with ultraviolet having a wavelength of 147 nm generated during the discharge of an inert mixed gas such as He+Xe, Ne+Xe or He+Ne+Xe. This PDP can be easily made thin and large, and it can provide greatly increased image quality with the recent development of the relevant technology. Particularly, a three-electrode AC surface discharge type PDP has advantages of lower driving voltage and longer product lifespan as a wall charge is accumulated on a surface in discharging and electrodes are protected from sputtering caused by discharging.

FIG. 1 is a perspective view showing the configuration of a discharge cell of a conventional plasma display panel. Referring now to FIG. 1, the discharge cell of the conventional plasma display panel includes a scan electrode Y and a sustain electrode Z which are formed on the bottom surface of an upper substrate 10, and an address electrode X formed on a lower substrate 18. Each of the scan electrode Y and the sustain electrode Z includes transparent electrodes 12Y and 12Z, and metal bus electrodes 13Y and 13Z which have a line width smaller than that of the transparent electrodes 12Y and 12Z and are respectively disposed at one side edges of the transparent electrodes.

The transparent electrodes 12Y and 12Z are typically formed using indium-tin-oxide (hereinafter, referred to as 'ITO') on the upper substrate 10. The metal bus electrodes 13Y and 13Z are formed on the transparent electrodes 12Y and 12Z usually using a metal such as chromium (Cr) and serve to reduce a voltage drop by the transparent electrodes 12Y and 12Z having high resistance. An upper dielectric layer 14 and a protection film 16 are laminated on the upper substrate 10 in which the scan electrode Y and the sustain electrode Z are formed in parallel. Wall charges generated upon the plasma discharge are accumulated on the upper dielectric layer 14. The protection film 16 serves to prevent damage of the upper dielectric layer 14 due to sputtering occurred upon the plasma discharge and to increase emission efficiency of secondary electrons. The protection film 16 is typically formed using magnesium oxide (MgO).

A lower dielectric layer 22 and barrier ribs 24 are formed on the lower substrate 18 in which the address electrode X is formed. A fluorescent material layer 26 is covered on the lower dielectric layer 22 and the barrier ribs 24. The address electrode X is formed in the direction to intersect the scan electrode Y and the sustain electrode Z. The barrier ribs 24 are formed in a stripe or lattice type and serve to prevent ultraviolet rays and a visible ray generated due to the discharge from leaking toward neighboring discharge cells. The fluorescent material layer 26 is excited by ultraviolet rays generated upon the plasma discharge to generate any one visible ray of red, green and blue lights. Inert mixed gases are inserted into a discharge space defined between the upper/lower substrates 10 and 18 and the barrier ribs 24.

This three-electrode AC surface discharge type PDP is divided into a plurality of sub-fields and is driven. In the period of each of the sub-fields, lights are emitted by the number proportional to a weighted value of video data, thereby displaying the gray level. The plurality of sub-fields are sub-divided into a reset period, an address period, a sustain period and a blanking period, and are driven.

In the above, the reset period is a period for forming an uniform wall charge on the discharge cell, the address period is a period for generating an selective address discharge according to a logical value of the video data, and the sustain period is a period for maintaining discharge in the discharge cell from which the address discharge is generated.

An address discharge and a sustain discharge of the AC surface discharge type PDP driven thus require high voltage of more than several hundreds of volts. Thus, in order to minimize the driving power necessary for the address discharge and the sustain discharge, an energy recovery apparatus is used. The energy recovery apparatus is adapted to recover a voltage between the scan electrode Y and the sustain electrode Z and to use the recovered voltage as a driving voltage for a subsequent discharge.

FIG. 2 is a circuit diagram showing an energy recovery apparatus formed on the scan electrode Y for recovering a voltage of the sustain discharge. Practically, the energy recovery apparatus is placed symmetrically to the sustain electrode Z with respect to a central panel capacitor (Cp).

Referring to FIG. 2, a conventional energy recovery apparatus includes an inductor L connected between a panel capacitor Cp and a source capacitor Cs, a first switch S1 and a third switch S3 which are connected in parallel between the source capacitor Cs and the inductor L, diodes D5 and D6 which are disposed between the first and third switches S1, S3 and the inductor L, and a second switch S2 and the fourth switch S4 which are connected in parallel between the inductor L and the panel capacitor Cp.

The panel capacitor Cp represents equivalent capacitance formed between the scan electrode Y and the sustain electrode Z. The second switch S2 is connected to a reference voltage source Vs, and the fourth switch S4 is connected to a ground voltage source GND. The source capacitor Cs recovers and charges the voltage which is charged in the panel capacitor Cp during sustain discharging, and provides again the charged voltage to the panel capacitor cp.

To this end, the source capacitor Cs has a capacitance capable of charging the voltage of Vs/2 that corresponds to a half of the reference voltage source Vs. The inductor L forms a resonant circuit together with the panel capacitor Cp. The first to fourth switches S1 to S4 control the flow of current. The fifth diode D5 and the sixth diode D6 both prevent the flow of electric current from reversing. Further, the internal diodes D1 to D4 each disposed within the first to fourth switches S1 to S4 also prevent the flow of electric current from reversing.

FIG. 3 is a timing showing ON/OFF timings of the switches and a waveform diagram showing output waveforms of the panel capacitors of FIG. 2.

The operation procedure will now be explained on the assumption that the panel capacitor Cp is charged with a voltage of 0 volt and the source capacitor Cs is charged with a voltage of Vs/2 before a period of T1.

In a period of T1, the first switch S1 is turned on, so that an electric current path is formed from the source capacitor Cs to the panel capacitor Cp through the first switch S1 and the inductor L. When the electric current path is formed, the voltage of Vs/2 charged in the source capacitor Cs is supplied to the panel capacitor Cp. In this time, the inductor L and the panel capacitor Cp form a serial resonant circuit, so that the panel capacitor Cp is charged with the voltage of Vs that is twice the voltage of the source capacitor Cs.

In a period of T2, the second switch S2 is turned on. When the second switch S2 is turned on, the panel capacitor Cp is provided with the voltage of the reference voltage source Vs. That is, when the second switch S2 is turned on, the voltage of the reference voltage source Vs is supplied to the panel capacitor Cp, which prevents that the voltage value of the panel capacitor Cp falls below that of the reference voltage source Vs, thereby generating a stable sustain discharge. At this time, since the voltage of the panel capacitor Cp rises up to Vs during the period of T1, the voltage value that is supplied from the outside during the period of T2 can be minimized. That is, it is possible to reduce power consumption.

In a period of T3, the first switch S1 is turned off. In this time, the panel capacitor Cp maintains the voltage of the reference voltage source Vs. In a period of T4, the second switch S2 is turned off and the third switch S3 is turned on. When the third switch S3 is turned on, an electrical current path is formed from the panel capacitor Cp to the source capacitor Cs through the inductor L and the third switch S3, and the source capacitor Cs recovers the voltage that is charged in the panel capacitor Cp. In this time, the source capacitor Cs is charged with a voltage of Vs/2.

In a period of T5, the third switch S3 is turned off and the fourth switch S4 is turned on. When the fourth switch S4 is turned on, an electric current path is formed between the panel capacitor Cp and the ground voltage source GND, and the voltage of the panel capacitor Cp drops to 0 volt. In a period of T6, a state of T5 remains for a given time period. Practically, an AC driving pulse that is supplied to the scan electrode Y and the sustain electrode Z may be obtained as the periods of T1 to T6 are periodically cycled.

However, a large amount of manufacturing cost is required in order to fabricate this conventional energy recovery apparatus. That is, elements (a diode, a switching element, etc.) used in the conventional energy recovery apparatus should have an internal voltage that can withstand the voltage value of the reference voltage source Vs. Further, the fifth and sixth diodes D5 and D6 must have a rapid response speed. Therefore, since lots of elements having a rapid response speed and a high internal voltage are employed in a prior art, manufacturing cost is high.

SUMMARY OF THE INVENTION

Accordingly, an object of the present invention is to solve at least the problems and disadvantages of the background art.

An object of the present invention is to provide an energy recovery apparatus in which manufacturing cost can be reduced and method thereof.

According to one aspect of the present invention, there is provided an energy recovery apparatus, including a capacitive load equivalently formed between a scan electrode and a sustain electrode, an energy recovery unit for recovering energy charged in the capacitive load and again supplying the recovered energy to the capacitive load, an energy supply unit disposed between the energy recovery unit and the capacitive load, wherein the energy supply unit relays energy between the energy recovery unit and the capacitive load and supplies a reference voltage to the capacitive load so that stabilized discharging can be generated in the capacitive load, and an energy relay unit disposed between the energy recovery unit and the energy supply unit, for relaying energy between the energy recovery unit and the energy supply unit.

According to another aspect of the present invention, there is also provided an energy recovery method in which a reference voltage source supplies a reference voltage so that a stabilized sustain discharging is generated, the method including a first step of charging a first inductor of a magnetic-coupled inductor with energy charged in a source capacitor, a second step of charging a second inductor of the magnetic-coupled inductor when energy is charged in the first inductor, and a third step of supplying the energy charged in the second inductor to a capacitive load that is equivalently formed between a scan electrode and a sustain electrode.

According to the present invention, energy is relayed between a source capacitor and a panel capacitor through a transformer. Therefore, diodes need not to be used and manufacturing cost is thus reduced.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
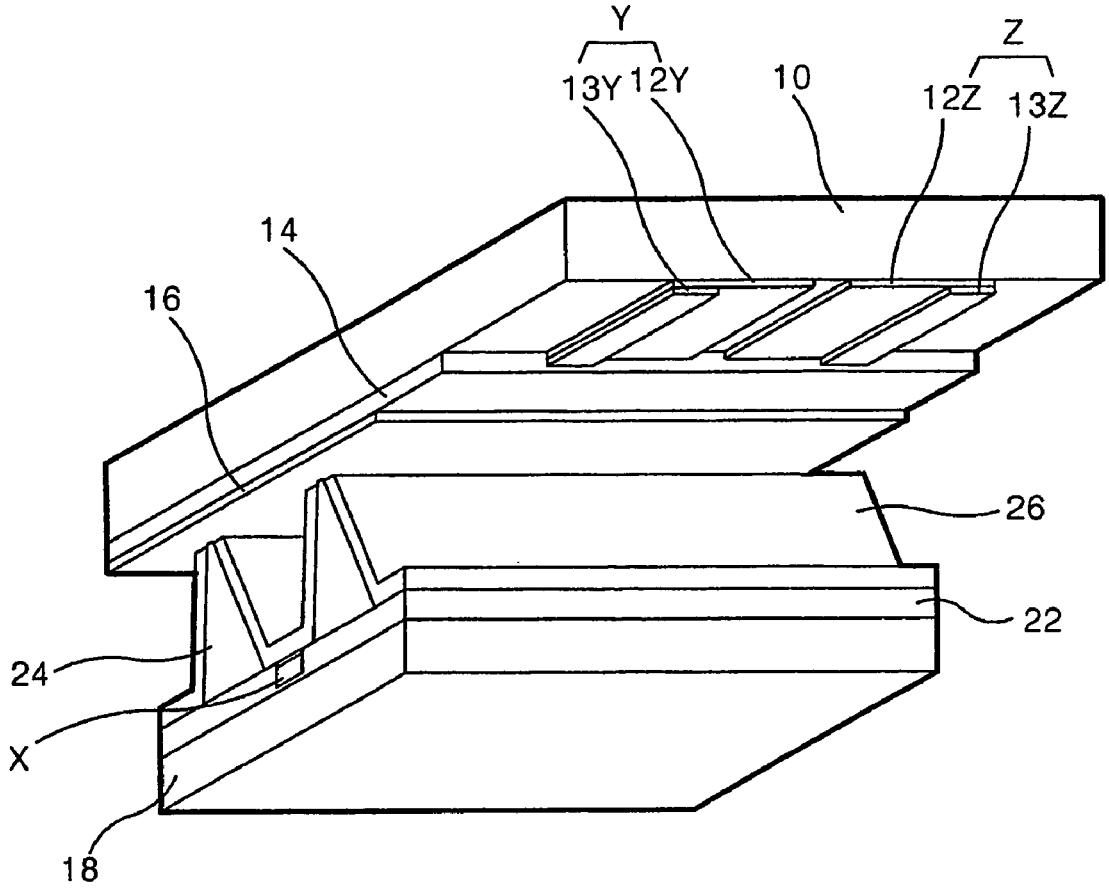
FIG. 1 is a perspective view showing the configuration of a discharge cell of a conventional plasma display panel.

Preferred embodiments of the present invention will be described in a more detailed manner with reference to the drawings.

To achieve the above object, according to one aspect of the present invention, there is provided an energy recovery apparatus, including a capacitive load equivalently formed between a scan electrode and a sustain electrode, an energy recovery unit for recovering energy charged in the capacitive load and again supplying the recovered energy to the capacitive load, an energy supply unit disposed between the energy recovery unit and the capacitive load, wherein the energy supply unit relays energy between the energy recovery unit and the capacitive load and supplies a reference voltage to the capacitive load so that stabilized discharging can be generated in the capacitive load, and an energy relay unit disposed between the energy recovery unit and the energy supply unit, for relaying energy between the energy recovery unit and the energy supply unit.

The energy recovery unit includes a source capacitor for storing energy recovered from the capacitive load and again supplying the stored energy to the capacitive load, and a first switching element disposed between the source capacitor and the ground voltage source, wherein the first switching element is turned on when the energy charged in the source capacitor is supplied to the energy relay unit.

The energy supply unit includes a second switching element connected to the reference voltage source that supplies the reference voltage, and third and fourth switching elements connected in parallel between the second switching element and the ground voltage source.

The energy relay unit includes a magnetic-coupled inductor in which two or more coils are coupled magnetically.

The magnetic-coupled inductor includes a first inductor disposed between a first switching element and a source capacitor, and a second inductor disposed between a second switching element and a third switching element.

The third switching element is turned on when a second inductor is charged with energy charged in the capacitive load.

The fourth switching element is turned on when a ground voltage is supplied to the capacitive load.

The coils of the first inductor and the second inductor are wound in the same direction.

The coils of the first inductor and the second inductor are wound in the opposite direction to each other.

According to another aspect of the present invention, there is also provided an energy recovery method in which a reference voltage source supplies a reference voltage so that a stabilized sustain discharging is generated, the method including a first step of charging a first inductor of a magnetic-coupled inductor with energy charged in a source capacitor, a second step of charging a second inductor of the magnetic-coupled inductor when energy is charged in the first inductor, and a third step of supplying the energy charged in the second inductor to a capacitive load that is equivalently formed between a scan electrode and a sustain electrode.

The energy charged in the second inductor is supplied to the capacitive load when the energy supplied to the first inductor is cut off.

The energy charged in the second inductor is supplied to the capacitive load simultaneously when the second inductor is charged with the energy.

In the third step, the capacitive load is charged with the reference voltage.

The method further includes the step of supplying the voltage value of the reference voltage source to the capacitive load for a predetermined time after the third step.

The method further includes a fourth step of charging the second inductor with the energy charged in the capacitive load, a fifth step of charging the first inductor with energy when the second inductor is charged with energy, and a sixth step of charging the source capacitor with the energy charged in the first inductor.

The energy charged in the first inductor is supplied to the source capacitor when the energy supplied to the second inductor is cut off.

The energy charged in the first inductor is supplied to the source capacitor simultaneously when the first inductor is charged with the energy.

Figure 4:
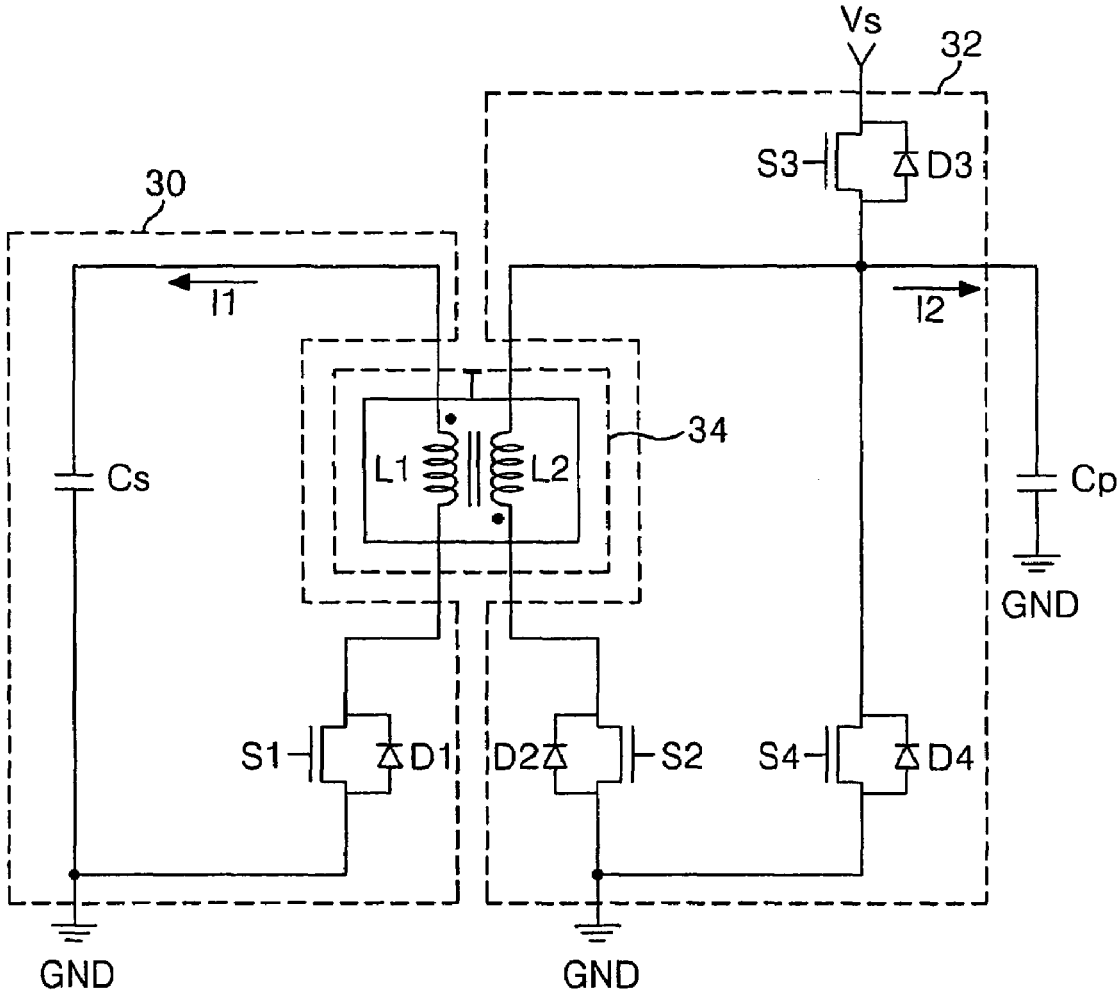
FIG. 4 is a circuit diagram showing an energy recovery apparatus according to an embodiment of the present invention.

FIG. 4 is a circuit diagram showing an energy recovery apparatus according to an embodiment of the present invention. It has been shown in FIG. 4 that the energy recovery apparatus is disposed at one side of a panel capacitor Cp. It is, however, to be noted that the energy recovery apparatus is practically disposed at both sides of the panel capacitor Cp in a symmetrical manner.

Referring to FIG. 4, the energy recovery apparatus according to an embodiment of the present invention includes an energy (voltage and/or current) recovery unit 30, an energy supply unit 32 and an energy relay unit 34.

The energy recovery unit 30 serves to recover energy from the energy supply unit 32 and to again supply the recovered energy to the energy supply unit 32. To this end, the energy recovery unit 30 includes a source capacitor Cs and a first switch S1. The source capacitor Cs recovers a voltage that is charged in the panel capacitor Cp and is charged with the voltage, and again supplies the charged voltage to the panel capacitor Cp, upon sustain discharging. The first switch S1 is turned on when energy is supplied to the energy relay unit 34. In this time, the first switch S1 has an internal diode D1 for preventing inverse current. The energy relay unit 34 is disposed between the first switch S1 and the source capacitor Cs.

The energy supply unit 32 is connected to a reference voltage source Vs, a ground voltage source GND and a panel capacitor Cp. This energy supply unit 32 serves to supply energy received from the energy relay unit 34 to the panel capacitor Cp and to again supply energy received from the panel capacitor Cp to the energy relay unit 34. The energy supply unit 32 further provides the voltage value of the reference voltage source Vs to the panel capacitor Cp.

To this end, the energy supply unit 32 includes a third switch S3 connected to the reference voltage source Vs, and second and fourth switches S2 and S4 connected in parallel between the third switch S3 and the ground voltage source GND. The energy relay unit 34 is disposed between the second switch S2 and the third switch S3. The third switch S3 is turned on when the reference voltage Vs is applied to the panel capacitor Cp. The second switch S2 is turned on when the voltage that is charged in the panel capacitor Cp is recovered by the energy recovery unit 30 (In the concrete, the second switch S2 is turned on when the energy charged in the panel capacitor Cp is supplied to the energy relay unit 34). The fourth switch S4 is turned on when the panel capacitor Cp is supplied with the ground voltage GND. Internal diodes D2 to D4 for preventing inverse current are respectively disposed in the second to fourth switches S2 to S4.

The energy relay unit 34 is disposed between the energy recovery unit 30 and the energy supply unit 32 and serves to relay energy. For this purpose, the energy relay unit 34 includes a transformer. The transformer includes a first inductor L1 disposed in the energy recovery unit 30 (disposed between Cs and S1), and a second inductor L2 disposed in the energy supply unit 32 (disposed between S2 and Cp). Coils of the first inductor L1 and the second inductor L2 are wound in the opposite direction to each other. Furthermore, the turn ratio of the first inductor L1 and the second inductor L2 is set experimentally so that energy can be transferred smoothly. Meanwhile, the panel capacitor Cp represents an equivalent capacitance formed between the scan electrode and the sustain electrode.

Figure 5:
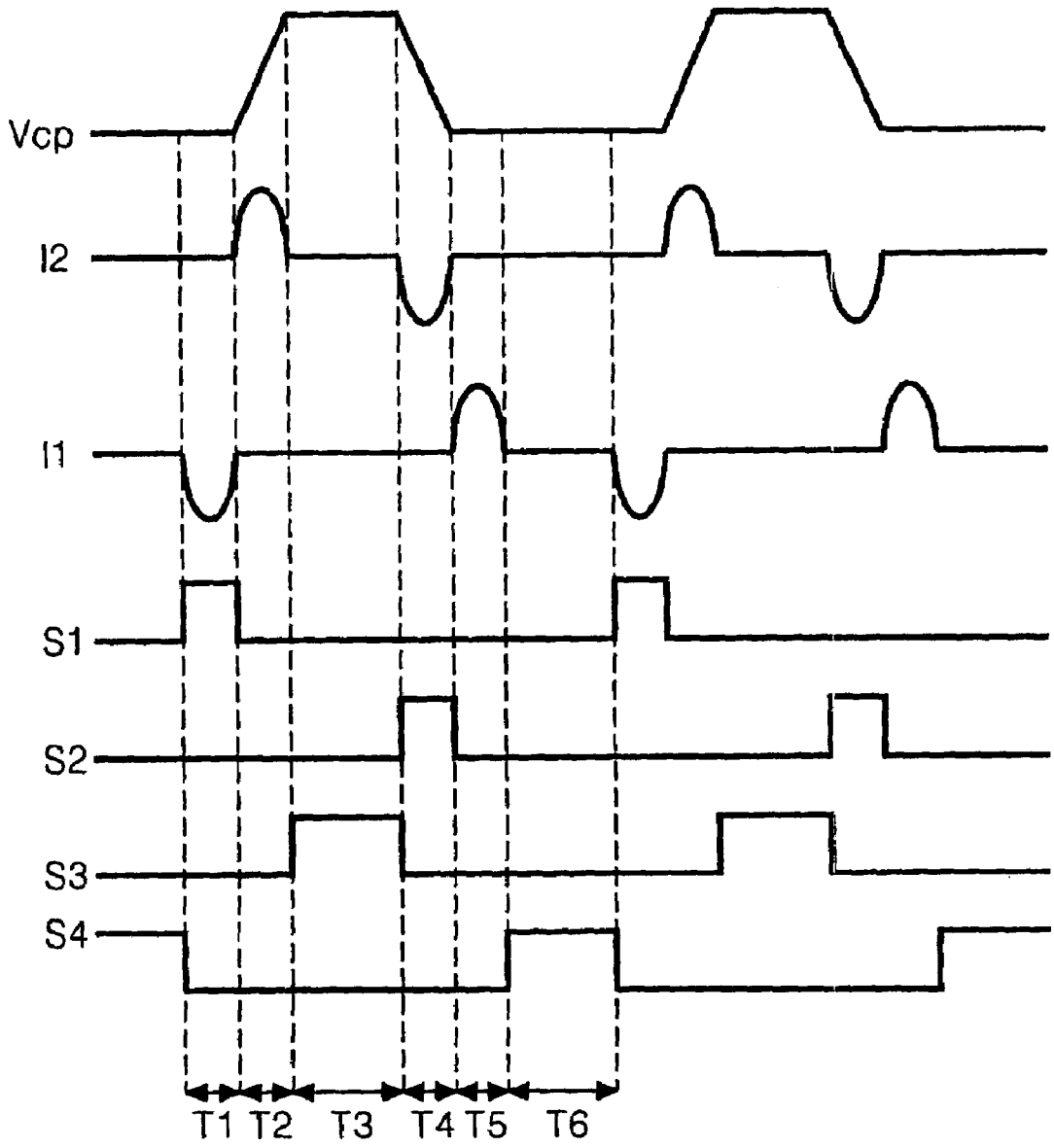
FIG. 5 is a timing showing ON/OFF timings of the switches and a waveform diagram showing output waveforms of the panel capacitors of FIG. 4.

FIG. 5 is a timing showing ON/OFF timings of the switches and a waveform diagram showing output waveforms of the panel capacitors of FIG. 4.

The operation procedure will now be explained in detail on the assumption that the panel capacitor Cp is charged with a voltage of 0 volt and the source capacitor Cs is charged with a constant voltage before a period of T1.

In the period of T1, the first switch S1 is turned on. When the first switch S1 is turned on, an electric current path is formed from the source capacitor Cs to the first switch S1 through the first inductor L1 of the transformer. In this time, the first inductor L1 is charged with current (or energy) supplied from the source capacitor Cs. Meanwhile, when the first inductor L1 is charged with current, the second inductor L2 is also charged with current. However, since the coils of the first inductor L1 and the second inductor L2 are wound in the opposite direction to each other, the current that is charged in the second inductor L2 is not supplied to the panel capacitor Cp (At this time, since the internal diode D2 of the second switch S2 is located in the backward direction, the current that is charged in the second inductor L2 is not provided to the ground voltage GND).

In a period of T2, the first switch S1 is turned off. That is, if the first inductor L1 is charged with a constant current (i.e., current of the first inductor L1 reaches a given value), the first switch S1 is turned off. When the first switch S1 is turned off, the polarity of the second inductor L2 is reversed. At this time, the current charged in the second inductor L2 is provided to the panel capacitor Cp. (An electric current path is formed because the internal diode D2 of the second switch S2 is located in the forward direction.) The T2 period continues until the voltage value of Vs is charged in the panel capacitor Cp.

In a period of T3, the third switch S3 is turned on. When the third switch S3 is turned on, the voltage value of the reference voltage source Vs is supplied to the panel capacitor Cp, so that the voltage value of the panel capacitor Cp is prevented dropping below the reference voltage source Vs. Accordingly, sustain discharging is generated stably. In the above, since the voltage value of the panel capacitor Cp rises up to Vs during the period T2, it is possible to minimize the voltage value supplied from the outside during the period T3 (That is, power consumption can be reduced).

In a period of T4, the second switch S2 is turned on. If the second switch S2 is turned on, an electric current path from the panel capacitor Cp to the second switch S2 through the second inductor L2 is formed, so that the voltage charged in the panel capacitor Cp is supplied to the second inductor L2. In this time, the second inductor L2 is charged with a predetermined current. Meanwhile, when the second inductor L2 is charged with current, the first inductor L1 is also charged with current. However, since the coils of the second inductor L2 and the first inductor L1 are wound in the opposite direction to each other, the current charged in the first inductor L1 is not provided to the source capacitor Cs. (In this time, as the internal diode D1 of the first switch S1 is located in the backward direction, the current charged in the first inductor L1 is not supplied to the ground voltage GND.)

In a period of T5, the second switch S2 is turned off. When the second switch S2 is turned off, the polarity of the first inductor L1 is reversed. At this time, the current charged in the first inductor L1 is supplied to the source capacitor Cs. (An electric current path is formed since the internal diode D1 of the first switch S1 is located in the forward direction.) In other words, the source capacitor Cs recovers energy from the panel capacitor Cp via the transformer.

In a period of T6, the fourth switch S4 is turned on. When the fourth switch S4 is turned on, the panel capacitor Cp is connected to the ground voltage source GND. The energy recovery apparatus of the present invention that is practically disposed at both sides of the panel capacitor Cp supplies an AC driving pulse to the panel capacitor Cp while alternately repeating the periods T1 to T6.

Figure 2:
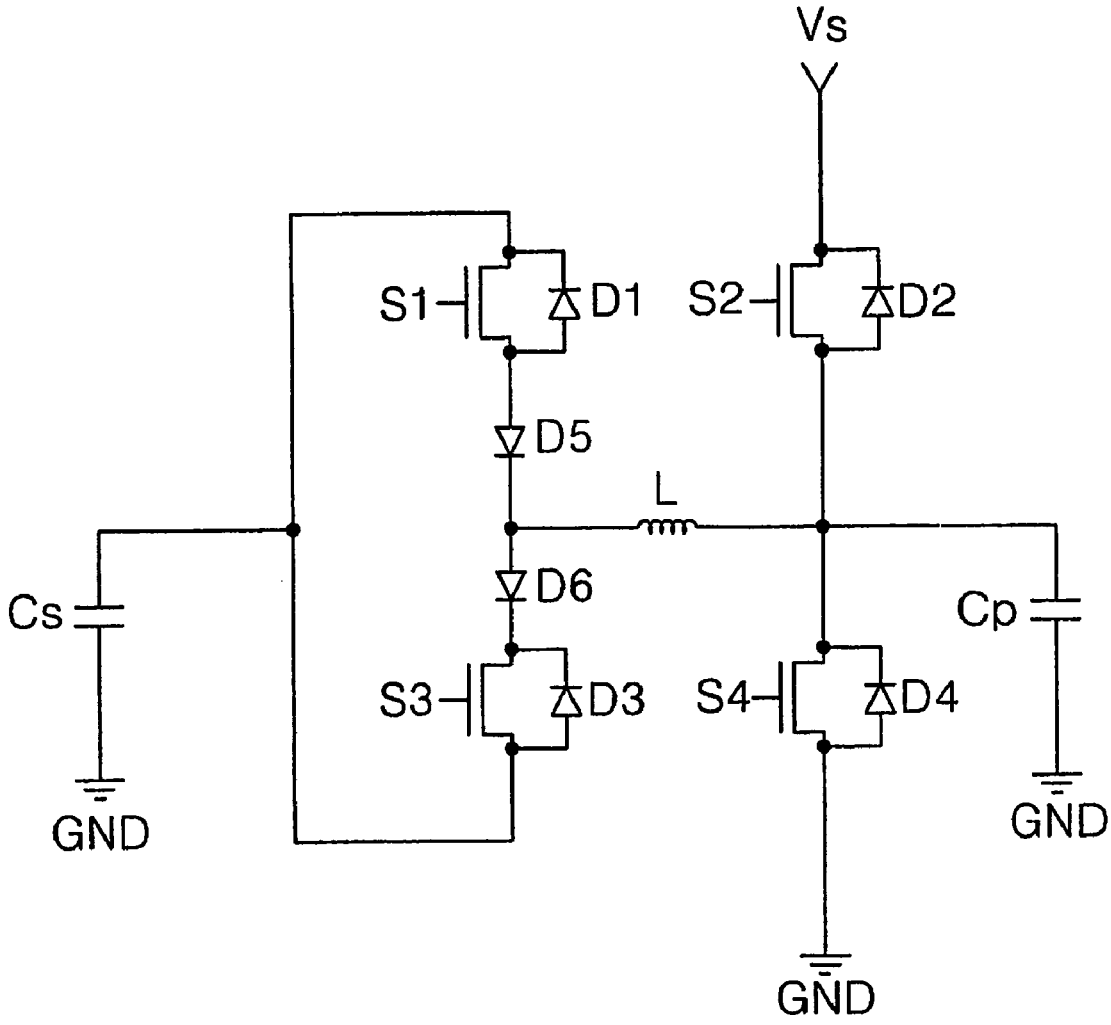
FIG. 2 is a circuit diagram illustrating an energy recovery apparatus formed on a scan electrode Y in order to recover a sustain discharging voltage.
Figure 3:
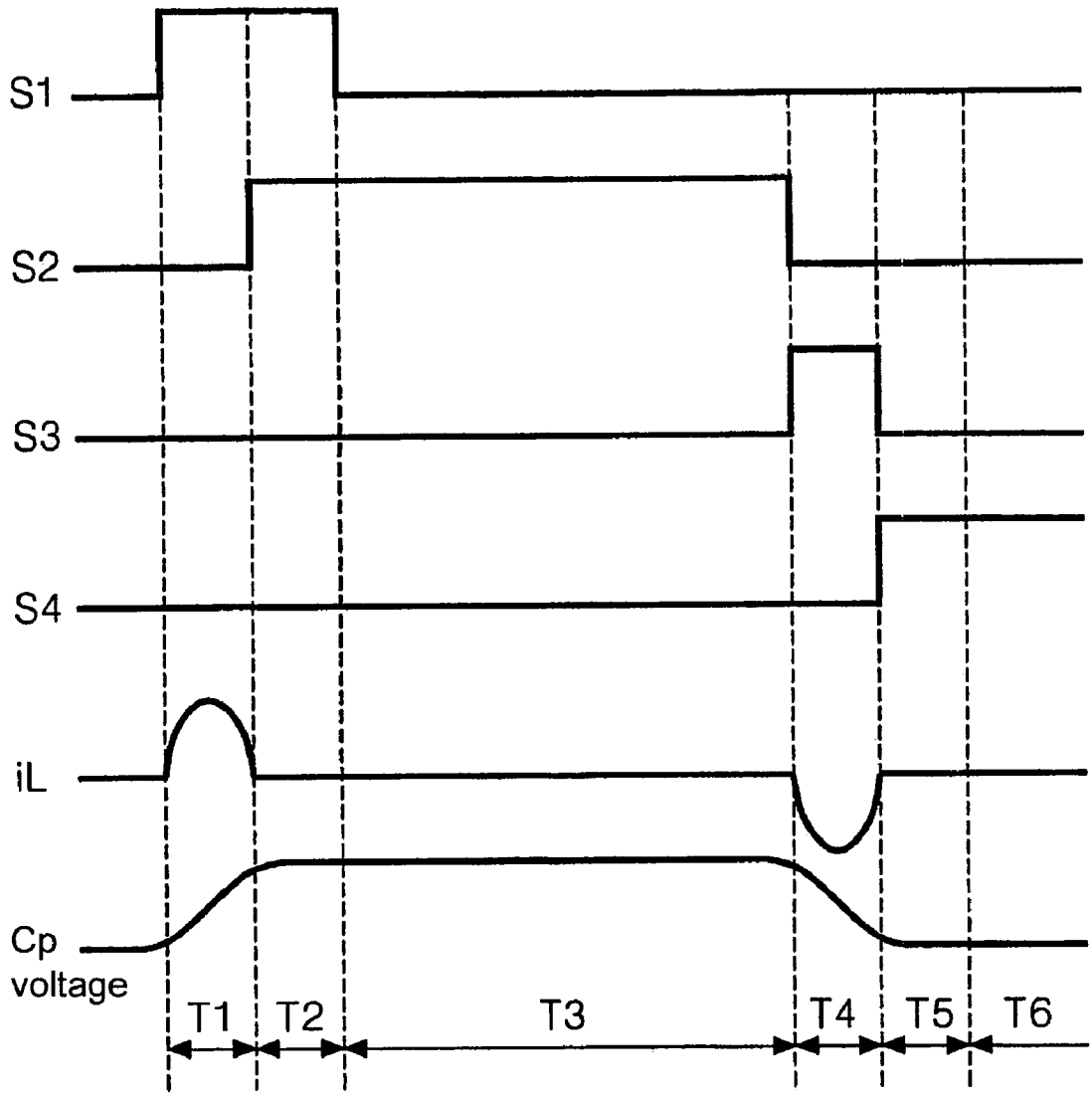
FIG. 3 is a timing showing ON/OFF timings of the switches and a waveform diagram showing output waveforms of the panel capacitors of FIG. 2.

Meanwhile, the energy recovery apparatus according to the present invention may not have the two diodes D5 and D6 of the conventional energy recovery apparatus shown in FIG. 2. As described above, in the present invention, the transformer 34 is used instead of the two diodes D5 and D6. This transformer can be installed with less cost than the diodes D5 and D6 having high internal voltage. Accordingly, the use of the energy recovery apparatus according to the present invention leads to reduction in manufacturing cost.

Figure 6:
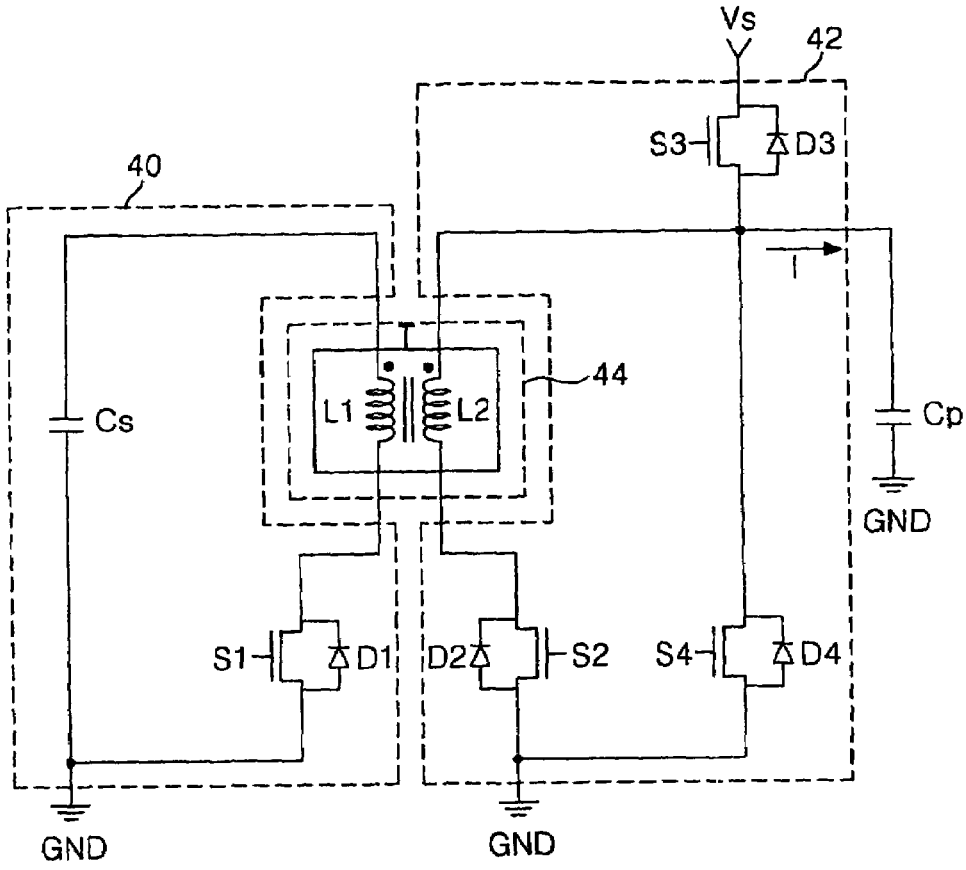
FIG. 6 is a circuit diagram showing an energy recovery apparatus according to another embodiment of the present invention.

FIG. 6 is a circuit diagram showing an energy recovery apparatus according to another embodiment of the present invention. It has been shown in FIG. 6 that the energy recovery apparatus is disposed at one side of a panel capacitor Cp. It is, however, to be noted that the energy recovery apparatus is practically disposed at both sides of the panel capacitor Cp in a symmetrical manner.

Referring to FIG. 6, the energy recovery apparatus according to an embodiment of the present invention includes an energy (voltage and/or current) recovery unit 40, an energy supply unit 42 and an energy relay unit 44.

The energy recovery unit 40 serves to recover energy from the energy supply unit 42 and to again supply the recovered energy to the energy supply unit 42. To this end, the energy recovery unit 40 includes a source capacitor Cs and a first switch S1. The source capacitor Cs recovers a voltage that is charged in the panel capacitor Cp and is charged with the voltage, and again supplies the charged voltage to the panel capacitor Cp, upon sustain discharging. The first switch S1 is turned on when energy is supplied to the energy relay unit 44. In this time, the first switch S1 has an internal diode D1 for preventing inverse current. The energy relay unit 44 is disposed between the first switch S1 and the source capacitor Cs.

The energy supply unit 42 is connected to a reference voltage source Vs, a ground voltage source GND and a panel capacitor Cp. This energy supply unit 42 serves to supply energy received from the energy relay unit 44 to the panel capacitor Cp and to again supply energy received from the panel capacitor Cp to the energy relay unit 44. The energy supply unit 42 further provides the voltage value of the reference voltage source Vs to the panel capacitor Cp.

To this end, the energy supply unit 42 includes a third switch S3 connected to the reference voltage source Vs, and second and fourth switches S2 and S4 that are connected in parallel between the third switch S3 and the ground voltage source GND. The energy relay unit 44 is disposed between the second switch S2 and the third switch S3. The third switch S3 is turned on when the reference voltage Vs is applied to the panel capacitor Cp. The second switch S2 is turned on when the voltage charged in the panel capacitor Cp is recovered by the energy recovery unit 40 (In the concrete, the second switch S2 is turned on when the energy charged in the panel capacitor Cp is supplied to the energy relay unit 44). The fourth switch S4 is turned on when the panel capacitor Cp is supplied with the ground voltage GND. Internal diodes D2 to D4 for preventing inverse current are respectively disposed in the second to fourth switches S2 to S4.

The energy relay unit 44 is disposed between the energy recovery unit 40 and the energy supply unit 42 and serves to relay energy. For this purpose, the energy relay unit 44 includes a transformer. The transformer includes a first inductor L1 disposed in the energy recovery unit 40 (disposed between Cs and S1), and a second inductor L2 disposed in the energy supply unit 42 (disposed between S2 and Cp). Coils of the first inductor L1 and the second inductor L2 are wound in the same direction. Furthermore, the turn ratio of the first inductor L1 and the second inductor L2 is set experimentally so that energy can be transferred smoothly. Meanwhile, the panel capacitor Cp represents an equivalent capacitance formed between the scan electrode and the sustain electrode.

Figure 7:
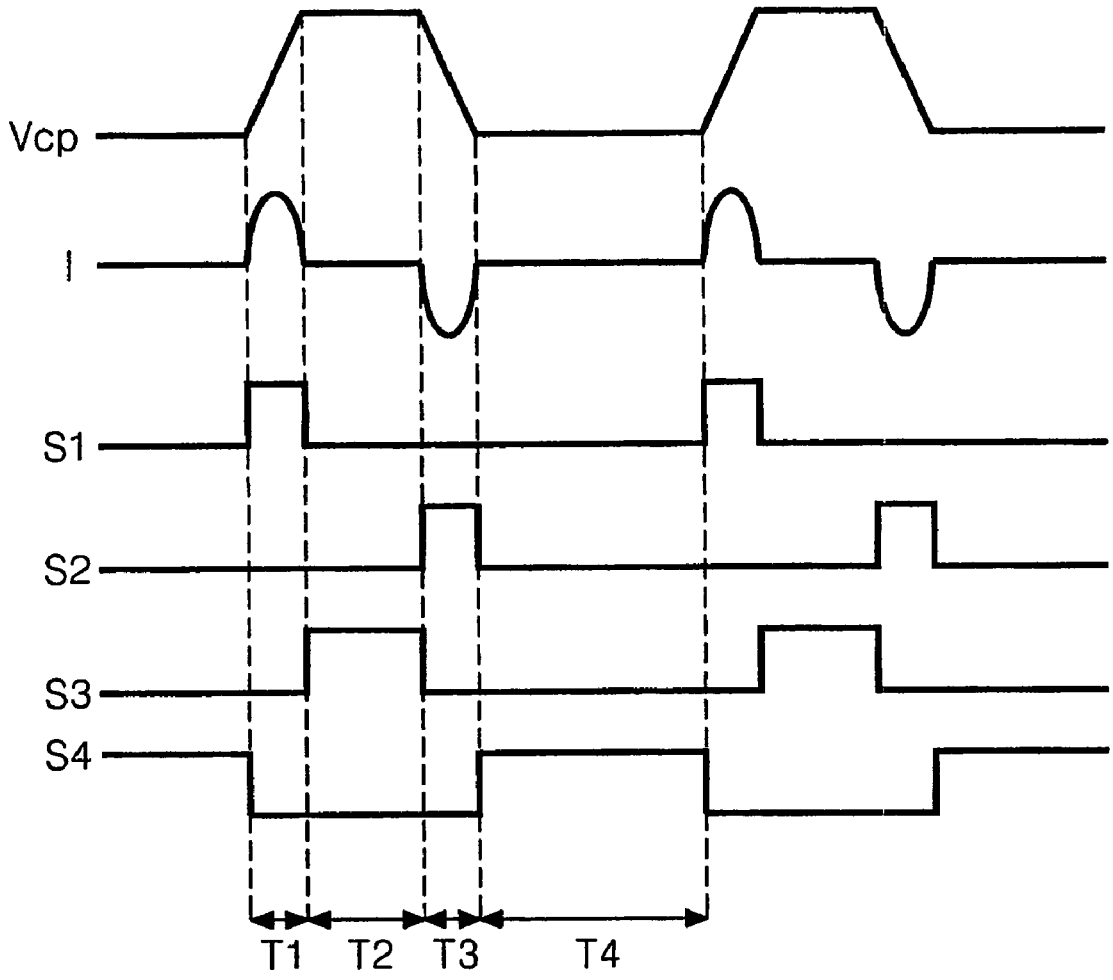
FIG. 7 is a timing showing ON/OFF timings of the switches and a waveform diagram showing output waveforms of the panel capacitors of FIG. 6.

FIG. 7 is a timing showing ON/OFF timings of the switches and a waveform diagram showing output waveforms of the panel capacitors of FIG. 6.

The operation procedure will now be explained in detail on the assumption that the panel capacitor Cp is charged with a voltage of 0 volt and the source capacitor Cs is charged with a constant voltage before a period of T1.

In the period of T1, the first switch S1 is turned on. When the first switch S1 is turned on, an electric current path is formed from the source capacitor Cs to the first switch S1 through the first inductor L1 of the transformer. In this time, the first inductor L1 is charged with current (or energy) supplied from the source capacitor Cs. Meanwhile, when the first inductor L1 is charged with the current, the second inductor L2 is also charged with current. At this time, since the coils of the first inductor L1 and the second inductor L2 are wound in the same direction, the current charged in the second inductor L2 is supplied to the panel capacitor Cp. (At this time, as the internal diode D2 of the second switch S2 is located in the forward direction, an electric current path is formed.) This period T1 continues until the voltage value of Vs is charged in the panel capacitor Cp.

In a period of T2, the third switch S3 is turned on. When the third switch S3 is turned on, the voltage value of the reference voltage source Vs is provided to the panel capacitor Cp, so that the voltage value of the panel capacitor Cp is prevented from dropping below the reference voltage source Vs. Accordingly, sustain discharging is generated stably. In this time, as the voltage value of the panel capacitor Cp rises up to Vs during the period T1, the voltage value that is supplied from the output during T2 can be minimized. (i.e., power consumption can be reduced.)

In a period of T3, the second switch S2 is turned on. When the second switch S2 is turned on, an electric current path is formed from the panel capacitor Cp to the second switch S2 through the second inductor L2, so that energy charged in the panel capacitor Cp is supplied to the second inductor L2. At this time, the second inductor L2 is charged with a predetermined current. Meanwhile, when the second inductor L2 is charged with the current, the first inductor L1 is also charged with current. In this time, since the coils of the second inductor L2 and the first inductor L1 are wound in the same direction, the current charged in the first inductor L1 is supplied to the source capacitor Cs. (In this time, since the internal diode D1 of the first switch S1 is located in the forward direction, an electric current path is formed.) That is, the source capacitor Cs recovers energy from the panel capacitor Cp via the transformer.

In a period of T4, the fourth switch S4 is turned on. When the fourth switch S4 is turned on, the panel capacitor Cp is connected to the ground voltage source GND. Practically, the energy recovery apparatus of the present invention disposed at both sides of the panel capacitor Cp supplies an AC driving pulse to the panel capacitor Cp while alternately repeating the periods T1 to T4.

Meanwhile, the energy recovery apparatus according to the present invention may not have the two diodes D5 and D6 of the conventional energy recovery apparatus shown in FIG. 2. As described above, in the present invention, the transformer 34 is used instead of the two diodes D5 and D6. This transformer can be installed with less cost than the diodes D5 and D6 having high internal voltage. Accordingly, the use of the energy recovery apparatus according to the present invention leads to reduction in manufacturing cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An energy recovery apparatus, comprising:

a capacitive load equivalently formed between a scan electrode and a sustain electrode;

an energy recovery unit for recovering energy charged in the capacitive load and again supplying the recovered energy to the capacitive load;

an energy supply unit disposed between the energy recovery unit and the capacitive load, wherein the energy supply unit relays energy between the energy recovery unit and the capacitive load and supplies a reference voltage to the capacitive load so that stabilized discharging can be generated in the capacitive load; and an energy relay unit disposed between the energy recovery unit and the energy supply unit, for relaying energy between the energy recovery unit and the energy supply unit.

2. The energy recovery apparatus as claimed in claim 1, wherein the energy recovery unit comprises: a source capacitor for storing energy recovered from the capacitive load and again supplying the stored energy to the capacitive load; and a first switching element disposed between the source capacitor and the ground voltage source, wherein the first switching element is turned on when the energy charged in the source capacitor is supplied to the energy relay unit.

3. The energy recovery apparatus as claimed in claim 1, wherein the energy supply unit comprises a second switching element connected to the reference voltage source that supplies the reference voltage, and third and fourth switching elements connected in parallel between the second switching element and the ground voltage source.

4. The energy recovery apparatus as claimed in claim 3, wherein the third switching element is turned on when a second inductor is charged with energy charged in the capacitive load.

5. The energy recovery apparatus as claimed in claim 3, wherein the fourth switching element is turned on when the ground voltage is supplied to the capacitive load.

6. The energy recovery apparatus as claimed in claim 1, wherein the energy relay unit includes a magnetic-coupled inductor in which two or more coils are coupled magnetically.

7. The energy recovery apparatus as claimed in claim 6, wherein the magnetic-coupled inductor comprises a first inductor disposed between a first switching element and a source capacitor, and a second inductor disposed between a second switching element and a third switching element.

8. The energy recovery apparatus as claimed in claim 7, wherein the coils of the first inductor and the second inductor are wound in the same direction.

9. The energy recovery apparatus as claimed in claim 7, wherein the coils of the first inductor and the second inductor are wound in the opposite direction to each other.

10. An energy recovery method in which a reference voltage source supplies a reference voltage so that a stabilized sustain discharging is generated, the method comprising:

a first step of charging a first inductor of a magnetic-coupled inductor with energy charged in a source capacitor;

a second step of charging a second inductor of the magnetic-coupled inductor when energy is charged in the first inductor; and a third step of supplying the energy charged in the second inductor to a capacitive load that is equivalently formed between a scan electrode and a sustain electrode.

11. The method as claimed in claim 10, wherein the energy charged in the second inductor is supplied to the capacitive load when the energy supplied to the first inductor is cut off.

12. The method as claimed in claim 10, wherein the energy charged in the second inductor is supplied to the capacitive load simultaneously when the second inductor is charged with the energy.

13. The method as claimed in claim 10, wherein in the third step, the capacitive load is charged with the reference voltage.

14. The method as claimed in claim 10, further comprising the step of supplying a voltage value of the reference voltage source to the capacitive load for a predetermined time after the third step.

15. The method as claimed in claim 10, further comprising:

a fourth step of charging the second inductor with the energy charged in the capacitive load;

a fifth step of charging the first inductor with energy when the second inductor is charged with energy; and a sixth step of charging the source capacitor with the energy charged in the first inductor.

16. The method as claimed in claim 15, wherein the energy charged in the first inductor is supplied to the source capacitor when the energy supplied to the second inductor is cut off.

17. The method as claimed in claim 15, wherein the energy charged in the first inductor is supplied to the source capacitor simultaneously when the first inductor is charged with the energy.

* * * * *